United States Patent [19]

Harbauer et al.

[11] 4,356,363

[45] Oct. 26, 1982

[54] LOCKING DEVICE FOR CONTACT CARRIERS

[75] Inventors: Werner Harbauer, Schwandorf; Edgar Wiessner, Amberg, both of Fed. Rep. of Germany

[73] Assignee: Siemens Aktiengesellschaft, Berlin and Munich, Fed. Rep. of Germany

[21] Appl. No.: 184,427

[22] Filed: Sep. 5, 1980

[30] Foreign Application Priority Data

Sep. 18, 1979 [DE] Fed. Rep. of Germany ..... 2937710

[51] Int. Cl.[3] ..... H01H 9/20

[52] U.S. Cl. ..... 200/50 C; 335/161

[58] Field of Search ..... 200/50 C, 5 B, 5 C, 200/286, 287; 335/160, 161

[56] References Cited

U.S. PATENT DOCUMENTS

| | | | |
|---|---|---|---|
| 1,915,948 | 6/1933 | Pedrazzo | 200/287 |
| 2,713,092 | 7/1955 | Rucks et al. | 200/50 C X |
| 3,342,958 | 9/1967 | Arneberg | 200/50 C |
| 3,710,288 | 1/1973 | Grunert | 335/160 |

*Primary Examiner*—Grimley A. T.
*Assistant Examiner*—Morris Ginsburg
*Attorney, Agent, or Firm*—Kenyon & Kenyon

[57] ABSTRACT

A locking device for two juxtaposed and spaced electromagnetic switching devices is disclosed. In the switching devices, contact carriers are provided which can be moved back and forth between first and second switching positions. The motion of the contact carriers is regulated by a latching member which can be tilted into a latching position by actuating one of the contact carriers relative to the other contact carrier. The latching member is held in a frame and is preferably in the form of a balance beam. The latching member is pivotable on a support member in the form of a pin. The frame itself is engageable with a shoulder-shaped extension in openings of the housing walls of the electromagnetic switching devices. The locking device can be adapted to different conditions in a simple manner by adjusting the pin which is held in a threaded hole of the frame.

10 Claims, 5 Drawing Figures

LOCKING DEVICE FOR CONTACT CARRIERS

BACKGROUND OF THE INVENTION

The present invention relates to a locking device for two otherwise independently movable contact carriers which are arranged side by side and spaced from each other.

Each of the aforementioned carriers can move back and forth in its respective housing between first and second switching positions. A latching part always locks only one of the contact carriers in the first switching position. The latching part is pivotable and can be pivoted into a latched position by operation of one of the contact carriers relative to the other contact carrier. The latching part is supported in a frame held by the housing walls in a close-fitting manner.

In one known device of the above type (DE-AS 1 665 778), a frame-shaped housing with the latching part is inserted between two contact carriers, there being posts extending into the walls of the housings. The latching part comprises a first cylindrical section which is rotatably contained in a matching opening section of the frame part, so that the frame serves as a support for the cylindrical section. The latching part further comprises a second cylindrical section which is connected to the first cylindrical section via an intermediate piece and extends in length beyond the width of the frame, so that the second cylindrical section can extent into the range of motion of the contact carriers and provide for latching. In that locking device, relatively high accuracy in production is necessary due to the cylindrical support, in order to obtain reliable locking.

OBJECT AND SUMMARY OF THE INVENTION

It is an object of the present invention to provide a locking device for electromagnetic switches which can accommodate a wider range of tolerances in manufacture and assembly.

In accordance with the invention, a simple arrangement is provided which can accommodate wider tolerances in the manufacture and assembly of electromagnetic switches which include a locking device therefor, particularly in the manufacture of the housings, while at the same time providing a relatively simple, tight-fitting assembly between the housings.

According to the invention, an adjustable support for the locking device latching member is provided in the locking device frame.

If the locking device is used between two electromagnetic switching devices as a reversing switch, the magnetic path and the contact spacing of the make contact, which must not close simultaneously in both switching devices, and the position of the latching member are matched to each other in such a manner that a simple balance beam can be used as the latching member.

Preferably, the support is formed in accordance with the invention by an adjustable pin. A simple arrangement is thereby obtained. Advantageously, the adjustable pin is a molded screw and the frame is plastic. Preferably, the latching member has cylindrical end portions and a raised central portion receiving the support member. Defined support surfaces and low sliding resistances can thereby be obtained.

The latching member has no undercuts and can be produced in an injection mold with one parting plane. Good clamping of the frame at the housings with the simultaneous possibility of sealing is obtained with an elliptical frame. Advantageously, shoulder-like extensions are provided at the frame on both sides, which engage in openings in the housing walls.

The locking lever/frame/housing arrangement according to the invention, results in a closed design so that foreign matter is prevented from penetrating. In addition, the frame guides both housings with a close fit and narrow tolerances. Moreover, arranging the spherical support deep in a recess of the latching part so that the parts are connected to each other in a captive manner when the countersupports are inserted, permits the parts of the locking device to be preassembled without difficulty and without falling apart.

More specifically, the invention provides an improvement in the locking device for two juxtaposed, spaced contact carriers, each movable in a respective housing between first and second positions. The locking device includes a latching member pivotably supported in a frame held by the housing walls, the latching member locking only one of the contact carriers in its first switching position at a time and being pivotable into a latched position by moving one of the contact carriers relative to the other contact carrier. According to the invention, means are provided for adjustably and pivotably supporting the latching member comprising a support for the latching member adjustably secured to the frame of the locking device. The latching member is in the form of a balance beam in accordance with the disclosed embodiment.

The adjustable support includes a contoured end portion and the latching member includes a contoured recess or cavity for receiving the contoured end portion of the latching member.

In the disclosed embodiment: the support comprises a member having a generally spherical end portion; the support member comprises a pin including a threaded portion and the frame includes a threaded portion for adjustably receiving the threaded portion of the pin. Additionally, the latching member preferably has cylindrical end portions and a raised central portion which receives the spherical end portion of the support member. Also in the disclosed embodiment, the frame is elliptical and includes shoulder-shaped extensions on both sides thereof which are engaged in respective openings of the housing.

In accordance with one aspect of the invention, the support member is received in a recess or cavity of the latching member and is adjusted in the frame so that the latching member, the frame and the respective housing are captively engaged, both of the contact carriers thereby being prevented from moving into the first position.

These and other aspects of the present invention will be more apparent from the following description of the preferred embodiments of the invention taken in conjunction with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENT

Figure 1:
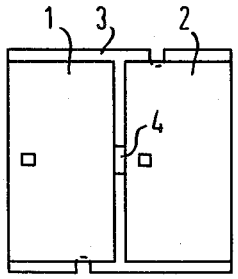
FIG. 1 is a top view of two electromagnetic switching devices which are fastened side by side on a base plate with a locking device disposed between them according to the invention.

Referring to FIG. 1, electromagnetic switching devices 1 and 2 are fastened side by side on a base plate 3 with a locking device 4 disposed between them.

Figure 2:
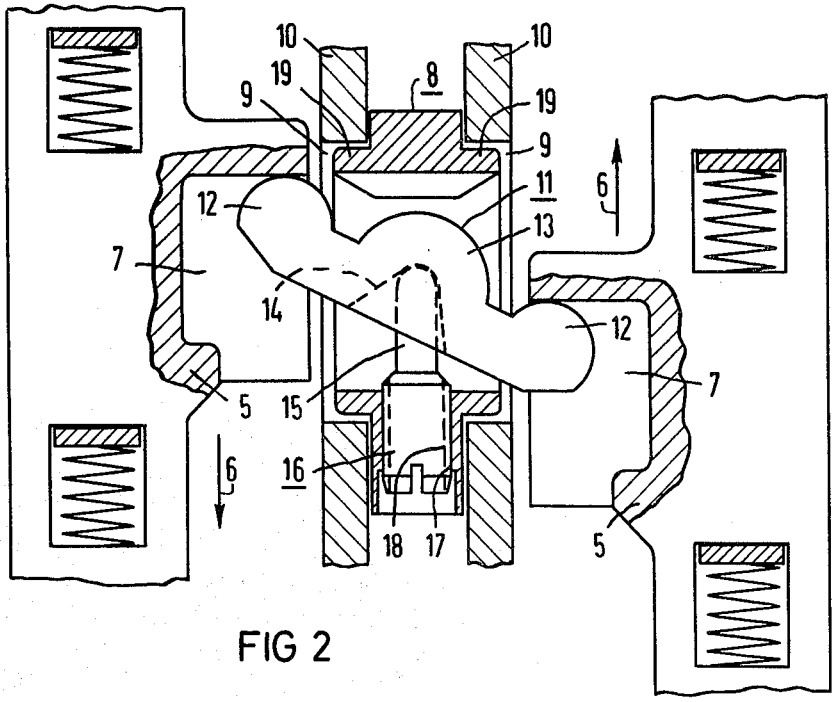
FIG. 2 is a partial side view, partially in cross-section through the locking device of FIG. 1 as assembled with the electromagnetic switching devices.

Referring to FIG. 2, the electromagnetic switching devices 1, 2 include respective contact carriers 5 which are movably guided as indicated by arrows 6. The recesses 7 of the contact carriers cooperate with the locking device 4. The locking device 4 comprises a frame 8 which is held with a tight fit in openings 9 of the housing walls 10 of the electromagnetic switching devices. The locking device 4 also includes a latching part 11 which according to the disclosed embodiment is in the form of a balance beam having cylindrical extensions 12 at its ends and a raised central part 13. The central part, while resembles a calotte, is provided with a recess or cavity 14 into which the spherical end 15 of an adjustable pin 16 extends. The threaded part 17 of the adjustable pin 16 is designed as a molded screw which can be turned into the hole 18 of the frame 8. The height of the fulcrum for the latching part 11 can be changed by adjusting the height of pin 16.

In FIG. 2, the right-hand contact carrier 5 is in the "on" position, and the latching part 11 prevents the left-hand contact carrier from being switched on. To insure that the latching part 11 prevents the left hand carrier from being switched on while the right-hand carrier is switched on, the pin 16 is adjusted so that tolerances in the assembly of the electromagnetic switching device or in the installation of the locking device are accommodated. The distance between the movable contact carrier and the latching beam in the rest position must be larger than or equal to one-half the magnetic path and smaller than the contact spacing of the make contacts.

Figure 3:
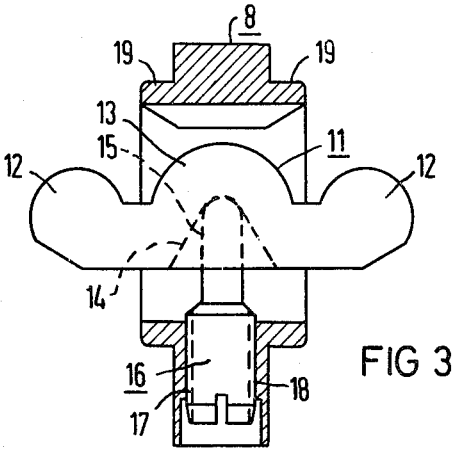
FIG. 3 is a side view in cross-section of the locking device of FIG. 1 detached from the switching devices.

The locking device according to the invention is also effective, however, if both contact carriers are in the "off" position and are urged into the "on" position by shock stresses on the overall arrangement. In that case, simultaneous switching-on of the electromagnetic switching devices is prevented, i.e., the pin 16 is adjusted high enough so that there is no switching change of any kind within the electromagnetic switching device while both contact carriers 5 move uniformly. This horizontal position of the latching device is shown in FIG. 3 with the latching device being shown separated from the electromagnetic switching devices.

Figure 4:
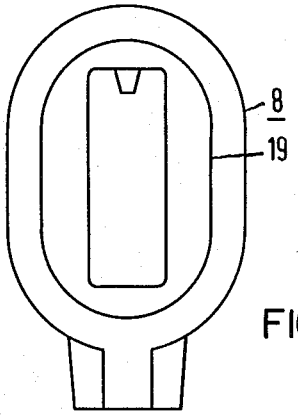

As shown in FIG. 4, the frame 8 has a shoulder-like extension 19 and is of elliptical shape so that a secure, tight-fit in the openings 9 of the housing walls 10 is insured. Additionally, sealing rings can be inserted to prevent contamination from entering the switching device or the locking device.

Figure 5:
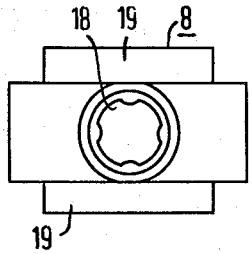
FIGS. 4 and 5 are a side view and top view, respectively, of the frame of the locking device of FIG. 1.

As shown in FIGS. 4 and 5, the frame 8 is a simple molded part and can be produced inexpensively. The openings 9 can be provided in the housing walls 10 so that they can be broken out and, if required, any contactor can be interlocked with the other.

The advantages of the present invention, as well as certain changes and modifications of the disclosed embodiments thereof, will be readily apparent to those skilled in the art. It is the applicants' intention to cover by their claims all those changes and modifications which could be made to the embodiments of the invention herein chosen for the purpose of the disclosure without departing from the spirit and scope of the invention.

What is claimed is:

1. An interlocked contact assembly comprising two contact carriers each movable between first and second positions, housings in which respective contact carriers are disposed, a mounting structure to which the two housings are secured so that the contact carriers are spaced apart in a side-by-side relationship, a locking device disposed between the two contact carriers for preventing both contact carriers from being in the first position at any one time, the locking device including a frame held by the housings, a latching member pivotally supported between the two contact carriers engaging both contact carriers and pivoting in response to movement of a contact carrier relative to the other contact carrier, means for pivotally supporting the latching member from the frame, and means for adjusting the latching member relative to the contact carriers.

2. The assembly according to claim 1 wherein the means for pivotally supporting the latching member comprises a support member supported by said frame, said adjusting means adjusting said support member.

3. The assembly according to claim 2, wherein the support member has a contoured end portion, and the latching member includes a contoured cavity for receiving the contoured end portion of the support member.

4. The assembly according to claim 3, wherein the support member end portion is generally spherical.

5. The assembly according to claim 4, wherein the support member comprises a pin, and said means for adjusting comprises a threaded portion on said pin and a threaded portion in said frame for adjustably receiving the threaded portion of the pin.

6. The assembly according to claim 2 or 5, wherein the latching member is in the form of a balance beam.

7. The assembly according to claim 6, wherein the latching member has cylindrical end portions and a raised central portion which receives the support member.

8. The assembly according to claim 1, wherein the frame is elliptical.

9. The assembly according to claim 8, wherein the frame includes shoulder-shaped extensions on both sides thereof which are engaged in respective openings of the housings.

10. The assembly according to claim 2, wherein the support member is received in a recess of the latching member, the recess being sized and the support member being adjustable in the frame so that the latching member is captively engaged in the frame.

* * * * *